US006175965B1

(12) United States Patent
Schoberg

(10) Patent No.: US 6,175,965 B1
(45) Date of Patent: Jan. 23, 2001

(54) PROTECTOR FOR TROUSER LEGS

(76) Inventor: Jesse Schoberg, W4402 County Rd. A, Elkhorn, WI (US) 53121

( * ) Notice: Under 35 U.S.C. 154(b), the term of this patent shall be extended for 0 days.

(21) Appl. No.: 09/437,674

(22) Filed: Nov. 10, 1999

(51) Int. Cl.[7] ..... A41D 1/06
(52) U.S. Cl. ..... 2/232; 2/222
(58) Field of Search ..... 2/232, 227, 231, 2/233, 125, 46, 222, 79, 82, 69, 123, 228, 238, 2.15; 450/101, 106, 112; 36/1.5

(56) References Cited

U.S. PATENT DOCUMENTS

| | | | | |
|---|---|---|---|---|
| 176,292 | | 4/1876 | Gardner . | |
| 229,031 | | 6/1880 | Campbell . | |
| 257,026 | | 4/1882 | Langan . | |
| 354,243 | | 12/1886 | Sandford . | |
| 495,178 | * | 4/1893 | Whitehead | 2/232 |
| 577,066 | | 2/1897 | Potter . | |
| 694,556 | | 3/1902 | Lanier et al. . | |
| 755,781 | * | 3/1904 | Lanier | 2/232 |
| 777,715 | | 12/1904 | Cullen et al. . | |
| 833,054 | * | 10/1906 | Hirsh | 2/232 |
| 1,211,472 | | 1/1917 | Marcelli . | |
| 1,992,235 | | 2/1935 | Pearl . | |
| 2,054,998 | * | 9/1936 | Winter | 2/232 |
| 2,111,945 | | 3/1938 | Segelin et al. . | |
| 2,480,276 | | 8/1949 | Wilkenfeld . | |
| 2,574,669 | | 11/1951 | Snider . | |
| 2,583,861 | | 1/1952 | Lewallen . | |
| 2,677,829 | | 5/1954 | Rothstein et al. . | |
| 4,064,641 | * | 12/1977 | Levine | 2/232 |

* cited by examiner

*Primary Examiner*—John J. Calvert
*Assistant Examiner*—Tejash Patel
(74) *Attorney, Agent, or Firm*—Andrus, Sceales, Starke & Sawall, LLP

(57) ABSTRACT

A leg protector for trousers comprises a strip of rubber material forming a loop that projects downwardly below the bottom edge of the leg opening in the trouser leg. Stitching attaches the rubber protector in such a manner that a finished hem is formed. Also disclosed is a method of forming a leg protector for trousers while simultaneously forming the finished hem.

5 Claims, 1 Drawing Sheet

FIG. 1
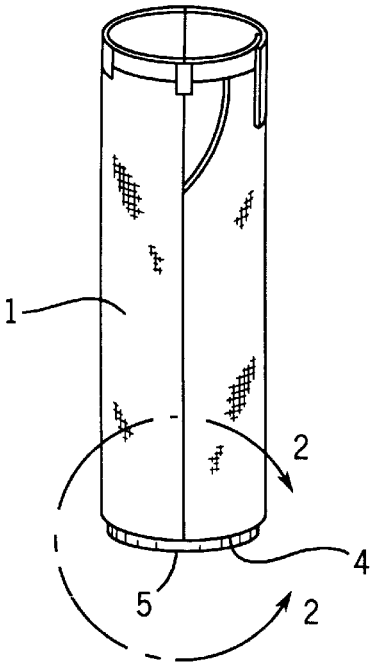
FIG. 2
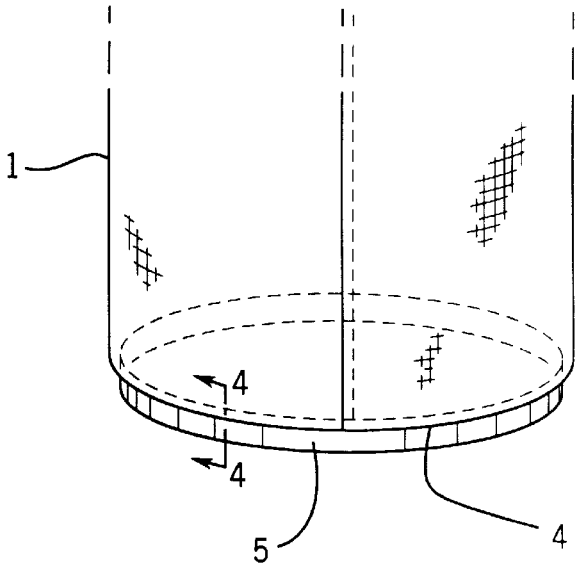
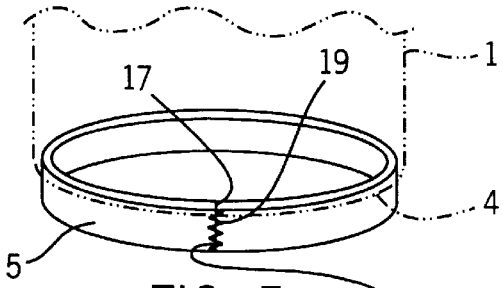
FIG. 5
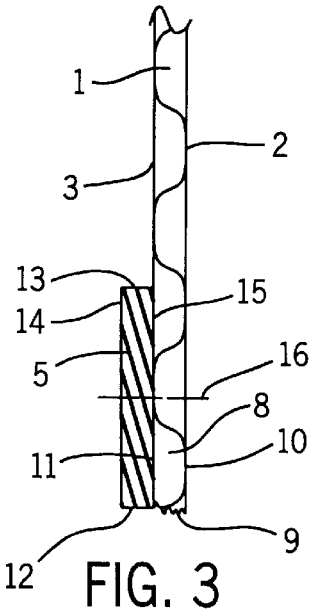
FIG. 3
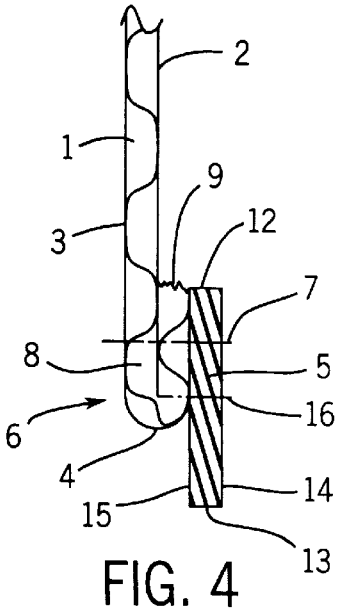
FIG. 4

PROTECTOR FOR TROUSER LEGS

BACKGROUND OF THE INVENTION

The present invention relates to wearing apparel, and more particularly to a protector or wear guard for the legs of trousers.

Many different types of devices are known in the prior art for use in protecting trouser legs from wearing and/or soiling. Most of such devices, however, cannot be used or even adapted to be used with trousers having "pipe" legs, also known as "wide" legs. These types of trousers present a style wherein the legs of such trousers are long enough and the bottoms wide enough to extend over a wearer's shoes so that the bottom edge or hem is purposely designed to actually drag on the ground when a user is walking. As a result, the hems and/or bottom edges of such trousers wear and become frayed very quickly. Also, due to the length of the legs, the bottom edges thereof become soiled very quickly. Further, in wet conditions, the lower portions of such trouser legs become quickly saturated with water, and water can actually wick upwardly because of the fabric used to make the trousers. Due to the above conditions, the pipe legs or wide legs of such trousers quickly become unsightly resulting in frequent cleaning and/or replacement.

SUMMARY OF THE INVENTION

The present invention provides a leg protector for trousers wherein a leg portion of the trousers has an inner surface, an outer surface, and a bottom edge defining a leg opening. A protector comprising a strip of rubber material extends along the inner surface of the leg portion to encompass the entire circumference of the leg opening in the trouser leg. Stitching passing through both the leg portion and the protector attaches the protector to the inner surface of the leg portion in such a manner that a finished hem is formed while at the same time the protector projects below the bottom edge of the leg opening of the trousers.

Since the protector extends below the bottom edge of the trouser legs, the protector itself engages the ground and prevents wearing of the bottoms of the trouser legs. The protector also helps to prevent soiling of the bottoms of the trouser legs, and in addition, since it is made of rubber, the protector can itself be easily cleaned. Finally, the protector prevents moisture from contacting the bottom edge of the trouser legs, and since it is composed of rubber, prevents wicking of moisture into the fabric of the trouser leg.

The present invention also provides a method of forming a leg protector for trousers. The method comprises the steps of providing a leg portion for trousers wherein the leg portion has an inner surface, an outer surface, a bottom edge defining a leg opening, and a bottom edge margin extending upwardly from the bottom edge of the leg portion, and further providing a protector for the bottom edge of the trouser leg comprising a strip of rubber material having a length substantially greater than its width. The protector is then positioned around the leg opening so that it engages or bears against the outer surface of the trouser leg adjacent the bottom edge thereof so that it extends both above and below the bottom edge. The protector is then sewn to the trouser leg by stitching passing through both the protector and the fabric of the trouser leg. Thereafter, the protector, now attached to the bottom edge of the trouser leg, is folded inwardly so that a hem is formed. After this folding step, what was the lower part of the protector in the previous step now becomes the upper part of the protector extending adjacent to the hem inside the leg opening of the trouser leg. Likewise, what was the upper part of the protector in the previous step now becomes the lower part of the protector and extends or projects downwardly from the hem to form the wear guard of the protector. Finally, stitching passing through the protector, the bottom edge margin and the trouser leg fabric attaches the protector in place and forms a finished hem. Thus, a simple method of attaching the protector to trouser legs is accomplished while at the same time forming a finished hem.

BRIEF DESCRIPTION OF THE SEVERAL VIEWS OF THE DRAWING

In the drawings:

FIG. 1 is a side elevational view of a trouser leg illustrating the protector of the present invention;

FIG. 2 is an enlarged fragmentary view of the bottom of the trouser leg illustrating the protector;

FIG. 3 is an enlarged fragmentary cross-sectional view illustrating a first step for attaching the protector to the trouser leg;

FIG. 4 is a view similar to FIG. 3 illustrating the final attachment of the protector wherein a finished hem is formed on the trouser leg; and FIG. 5 is a view similar to FIG. 2 illustrating the bar tacking of the ends of the protector together.

DETAILED DESCRIPTION OF THE INVENTION

Referring now to the drawings, FIGS. 1 and 2 illustrate the lower end of a trouser leg 1. Leg 1 includes an inner surface 2 which is adjacent a wearer's skin, an outer surface 3, a bottom finished edge 4 defining an opening for leg 1, and a protector 5 in accordance with the present invention. As shown, leg 1 is of the type referred to herein as a "pipe" leg or a "wide" leg. Thus, the bottom leg opening may be circular or oval in shape and is dimensioned to have a diameter that would normally completely encompass and be substantially wider than a wearer's shoe (not shown in FIG. 1). Also, leg 1 extends lengthwise so that without the protector 5 of the present invention the bottom finished edge 4 would normally engage or drag on the ground when a wearer walks. Thus, although the protector 5 to be hereinafter described is not limited to the use on pipe or wide leg trousers, the protector's use on such trousers' legs is most advantageous as will hereinafter be understood.

Trouser leg 1 may be composed of any typical material or fabric utilized to make wearing apparel. Preferably, trouser leg 1 is made of a cotton or cotton/polyester blend fabric. Nylon blends, rayon blends as well as other fabric materials commonly used to make clothing or wearing apparel may also be utilized, as is well known in the art.

As shown best in FIGS. 3 and 4, trouser leg 1 has a finished hem 6 bordering its leg opening. Hem 6 is comprised of bottom finished edge 4, stitching 7 visible on the outer surface 3 of trouser leg 1, and a bottom edge margin 8 of trouser leg 1. Bottom edge margin 8 has an unfinished edge 9, an interior surface 10 and an exterior surface 11. Edge margin 8 is doubled back inwardly so that, as shown best in FIG. 4, interior surface 10 lies against inner surface 2 of trouser leg 1, the unfinished edge 9 faces upwardly, finished edge 4 faces downwardly and the exterior surface 11 faces inwardly toward the leg opening. As shown, stitching 7 passes through protector 5, the bottom edge margin 8 adjacent unfinished edge 9 and trouser leg 1 spaced upwardly from bottom edge 4 so as to be visible on the outer surface 3 of trouser leg 1 to complete finished hem 6.

As shown best in FIGS. 2 and 5, protector 5 for finished hem 6 extends along the entire interior or circumference of hem 6 to form a loop and thereby circumferentially surround the leg opening in trouser leg 1. Protector 5 has an upper edge 12, a lower edge 13, an inner surface 14, and an outer surface 15, and is comprised of a strip of rubber material having a length substantially greater than its width and its width greater than its thickness. More specifically, protector 5 is approximately 25–30 inches in length, about 2 inches in width and has a thickness of about 3/16 of an inch. As shown best in FIG. 4, the upper edge 12 of protector 5 is located above hem 6, while the lower edge 13 of protector 5 projects below hem 6. Lower edge 13 of protector 5 thus becomes a wear surface which will frictionally engage the ground when a wearer is walking. As is readily apparent, the exact position of protector 5 may be adjusted slightly upwardly or slightly downwardly with respect to hem 6 to expose less or more, respectively, of protector 5 from beneath hem 6.

Although not forming part of hem 6, stitching 16 is used to initially fasten protector 5 onto trouser leg 1. As shown best in FIG. 3, stitching 16 passes through protector 5 approximately midway between its edges 12 and 13 and through edge margin 8 of trouser leg 1. However, after edge margin 8 is folded inwardly and hem 6 is formed, as best shown in FIG. 4, stitching 16 is not visible on the outer surface 3 of trouser leg 1.

Protector 5 is composed of a rubber material such as butadiene-styrene, polyisobutylene, butyl, or nitrile rubber. Such material provides good wear resistance and is impervious to water and moisture. Likewise, such material has sufficient workability to permit it to be fastened or affixed to the fabric of leg 1 via the stitching, herein described.

In order to form the leg protector assembly, protector 5 is first positioned such that its outer surface 15 lies against outer surface 3 of leg 1. Protector 5 is positioned so that lower edge 13 faces upwardly and is located above unfinished bottom edge 9 of leg 1 and upper edge 12 faces downwardly and is located beneath unfinished bottom edge 9 of leg 1. The length of protector 5 is then cut to match the circumference of the opening in leg 1 so that opposite ends 17 and 18 of protector 5 may be butted against each other, as shown best in FIG. 5. Thereafter, ends 17 and 18 are attached to each other by bar tacking 19 to form the protector 5 into a loop. Next, protector 5 is sewn or stitched onto leg 1 so that the stitching 16 passes through both the protector 5 midway between edges 12 and 13 and the fabric of edge margin 8 of trouser leg 1.

The next step is to fold bottom edge margin 8 inwardly along the entire circumference of leg 1. As shown best in FIG. 4, this folding step forms finished hem 6 and also rotates protector 5 so that lower edge 13 now faces downwardly and is located beneath hem 6 and upper edge 12 faces upwardly and is located above finished edge 4 of hem 6 along inner surface 2 of leg 1. Then, as shown best in FIG. 4, protector 5 is sewn to the inner surface 2 of leg 1 to affix or fasten it in place and simultaneously form finished hem 6. As shown in FIG. 4, stitching 7 extends through protector 5, adjacent upper edge 12 and through the fabric of edge margin 8 of leg 1. This forms the finished hem 6 as shown in FIG. 4. Thus, an easy technique for forming the leg protector assembly while simultaneously forming the finished hem 6 may be performed.

I claim:

1. A protector for a trouser leg, comprising:

trouser leg having an inner surface, an outer surface, and a finished hem bordering a leg opening, said hem comprising a bottom edge margin of said trouser leg having an interior surface and an exterior surface, said bottom edge margin doubled back inwardly so that said interior surface lies against the inner surface of said trouser leg and said exterior surface faces said leg opening;

a protector for said finished hem comprising a strip of rubber material having a length substantially greater than its width and its width greater than its thickness, said protector extending along the entire circumference of said leg opening to form a loop, said protector including an inner surface, an outer surface, an upper edge, and a lower edge, wherein said upper edge is disposed within said leg opening adjacent said finished hem so that the outer surface of said protector lies against the exterior surface of said finished hem, and wherein said lower edge projects below said finished hem; and fastening means for fastening said protector to the exterior surface of the bottom edge margin of said finished hem, said fastening means comprising first stitching passing through said protector, said bottom edge margin and said trouser leg so as to be visible on the outer surface of said leg portion, and second stitching spaced downwardly from said first stitching and passing through only said protector and said bottom edge margin so as to not be visible on the outer surface of said leg portion.

2. The leg protector of claim 1 wherein said rubber material is selected from the group consisting of butadiene-styrene, butyl, polyisobutylene and nitrile rubber.

3. The leg protector of claim 1 wherein said protector includes a pair of opposite ends butted together to form said loop.

4. A method of forming a protector for the bottom of a trouser leg, comprising the steps of:

providing a trouser leg having an inner surface, an outer surface, an unfinished bottom edge defining a leg opening, and a bottom edge margin extending upwardly from said unfinished bottom edge;

providing a protector for the unfinished bottom edge of said trouser leg, said protector comprising a strip of rubber material forming a loop having a length substantially greater than is width and its width greater than its thickness, said protector including an inner surface, an outer surface, an upper edge and a lower edge;

positioning said protector such that the outer surface of said protector lies against the outer surface of the bottom edge margin of said trouser leg and the lower edge faces upwardly and the upper edge faces downwardly;

stitching said protector to said bottom edge margin of said trouser leg at a location spaced from the lower edge of said protector and the unfinished bottom edge of said trouser leg;

folding said bottom edge margin inwardly into said leg opening until the inner surface of said bottom edge margin engages the inner surface of said trouser leg so that the unfinished bottom edge of said trouser leg and the upper edge of said protector both face upwardly and the lower edge of said protector faces downwardly;

fastening said bottom edge margin to said trouser leg to form a finished hem by stitching said protector to the bottom edge margin of said trouser leg and said bottom edge margin to said trouser leg at a location closely adjacent to the upper edge of said protector and the unfinished bottom edge of said trouser leg.

5. The method of claim 4 wherein said protector includes a pair of opposite ends, and further including the step of bar tacking said opposite ends together to form said protector into a loop.

* * * * *